US005451062A

United States Patent [19]

Malone

[11] Patent Number: 5,451,062

[45] Date of Patent: Sep. 19, 1995

[54] SCISSORS PLAYING CARD GAME

[76] Inventor: William E. Malone, 416 Dunbar St., Kingsport, Tenn. 37660

[21] Appl. No.: 314,717

[22] Filed: Sep. 29, 1994

[51] Int. Cl.[6] ..... A63F 1/00

[52] U.S. Cl. ..... 273/292; 273/299; 273/303

[58] Field of Search ..... 273/299, 292, 303, 308

[56] References Cited

U.S. PATENT DOCUMENTS

| | | | |
|---|---|---|---|
| 1,323,986 | 12/1919 | Joyce | 273/299 |
| 2,540,211 | 2/1951 | O'Keefe | 273/292 |
| 4,807,885 | 2/1989 | Chamblee et al. | 273/292 |
| 5,242,171 | 7/1993 | Hata | 273/292 |

FOREIGN PATENT DOCUMENTS

| | | | |
|---|---|---|---|
| 2304372 | 10/1976 | France | 273/299 |
| 10470 | of 1906 | United Kingdom | 273/299 |

*Primary Examiner*—Benjamin H. Layno
*Attorney, Agent, or Firm*—Malcolm G. Dunn

[57] ABSTRACT

A method for playing a card game in which the card deck has four series of numerical value cards, such as each series ranking from "2" through "20". Each player is dealt a predetermined number of cards. The remaining cards form a draw pile, and one card from the draw pile is turned face up to start a separate discard pile. The dealer then selects from his or her hand or from the discard pile cards the numerical value of which may be divided in half by the numbers of other selected cards or may be used to divide in half the numbers of other selected cards and plays them on the playing surface in a vertical row. The player may alternatively select from the sequential order and play in separate vertical rows on the playing surface matching cards the numbers of which cannot be used to divide in half the number of another card or to be used to be divided in half by the number of another card by placing one matching card uppermost and another matching card lowermost in a vertical row. A card is drawn from the draw pile when the player cannot continue to select and play, and if the player still cannot continue to select and play with the drawn card, the player then discards a card from his or her hand to the discard pile thereby passing play to the next player. The first player to exhaust all of the cards in his or her hand wins.

7 Claims, 3 Drawing Sheets

SCISSORS PLAYING CARD GAME

BACKGROUND OF THE INVENTION

Field of the Invention

The present invention relates to games and in particular to playing card games.

BACKGROUND OF THE INVENTION

Card playing has amused and entertained generations of both old and young folks for numerous years. Playing cards have been in existence for at least 600 years in Europe, probably since the 13th century, and for many centuries in oriental countries. Playing cards have been used as a principal implement for gaming, conjuring and divination, and also have been used as an aid in education, such as by printing instructive texts on the faces of playing cards. In the early years of the 20th century in the United States, 30 to 40 million decks were sold each year, reaching 54 million in 1929. During the depression in the 1930s card playing increased because it was an inexpensive diversion, but cards were less often replaced during that period, with the result that sales dropped to around 40 million. During World War II sales approached 100 million of which about 30 million were distributed free to servicemen.

The number and variety of playing card games over the centuries is not known with any exactitude. Many card games of present day can be played very quickly, while others, such as contract bridge can last upwards of a half an hour or longer for one game, depending upon the skill of the players and how much socializing occurs during the play of the hand.

Some card games are also educational in the sense that the game may teach in the playing itself arithmetic skills, such as addition, subtraction, multiplication and division, while also providing a measure of enjoyment, challenge and amusement. One example of the latter is shown in U.S. Pat. No. 5,242,171. Some of the educational card games also teach strategy as well as thinking skills. U.S. Pat. No. 4,807,885 is an example of a playing card game that reportedly requires skill and strategy to be successful.

The playing card game of the present invention can be played quickly, is educational, teaches strategy and thinking skills, is amusing, challenging and entertaining.

The game is called, "SCISSORS," because in the playing of the game, a first card is selected and played on a playing surface to be figuratively "scissored-in-half", that is, its numerical value is divided in half by selecting and playing on the playing surface a second card the numerical value of which is one-half that of the first card; and then, if possible, selecting and playing on the playing surface a third card the numerical value of which is one-half that of the second card, thereby figuratively "scissoring-in-half" the second card. During the playing of the game, the first card that was selected and played might conceivably be used to "scissor-in-half" another card that is selected and played later and that has a numerical value twice that of the first card. The object of the game is for one of the players to be the first to exhaust all of the cards in that player's hand and thus win the game. In the numerical sequence of the playing cards in the deck there will be some cards the numerical value of which cannot be played, figuratively, to "scissor-in-half" or divide in half another card or to be used to be "scissored-in-half" or to be divided in half by another card. These cards become, figuratively, "obstacles" to a player in the playing of the game. An "obstacle" card such as this can only be played if another "obstacle" card having the same numerical value becomes available to be selected and played by that player so as to "match" the first "obstacle" card. Alternatively, as part of that player's strategy, the "obstacle" card may be selected by that player to be discarded when that player can no longer play any other card during that player's turn.

SUMMARY OF THE INVENTION

The present invention, therefore, concerns a method of playing a card game wherein the playing cards include a series of numerical value cards in a predetermined sequential order. The method includes the steps of dealing a predetermined number of cards from a main deck of cards to each player, and upon completion of the deal placing the remaining cards in the main deck of cards face down on a playing surface to form a draw pile of cards and starting a discard pile of cards on the playing surface by transferring one card from the draw pile of cards and turning it face up and placing it in the discard pile on the playing surface separate from the draw pile of cards. The steps further include selecting during a player's turn from either the top of the discard pile or from the cards in the player's hand a card having a number that a) is half of or twice the number of a second card from either the top of the discard pile or from the cards in the player's hand, and playing both cards by placing the cards on the playing surface in a vertical row with the greater numbered card being placed uppermost and the halving numbered card being placed lowermost in the vertical row and covering the lower half of the uppermost card, and continuing to play by selecting either from the top of said discard pile or from the player's hand another card that b) is half of the number of the lowermost card in the vertical row or is twice the number of the uppermost card in the vertical row, or c) may start a new vertical row of uppermost and lowermost cards on the playing surface, and playing the card by placing the card on the playing surface by covering the lower half of the card above it or by sliding it half under the top half of the card below it in the vertical row, or by starting the aforementioned new vertical row of uppermost and lowermost numbered cards until there are no more cards in the player's hand or on top of the discard pile capable of being played by the player, drawing a card from said draw pile of cards, and if it is not possible to play the drawn card, then discarding a card from the player's hand to the top of said discard pile, at which time the player's turn is ended, or alternatively the player has exhausted all of the cards in the player's hand and in which event the player wins the card game.

The method also includes in the step of dealing a predetermined number of cards to each player the step of dealing a single card to each player in succession until each player has four cards.

The method also includes in the step of drawing a card from the draw pile of cards the step of the player continuing to draw a card from the draw pile of cards until the player can no longer play the drawn card.

The method also includes in the step of discarding a card from a player's hand to the top of the discard pile triggering the step of passing play onto the next player.

The method also includes in the steps of selecting and playing a card the steps of selecting a card that can match a number on another card that is not divisible by two and playing cards on the playing surface in a separate vertical row by placing a matched numbered card uppermost and the selected matching numbered card lowermost in the separate vertical row and covering half of the uppermost card.

The method further includes in the steps of selecting and playing a card the steps of selecting a card that can match a number on another card that is not divisible by two and that cannot be used to halve the number of any other card in the aforementioned sequential order, and playing the cards on the playing surface in a separate vertical row by placing a selected matched numbered card uppermost and a selected matching numbered card lowermost in the separate vertical row and covering half of the uppermost card.

The method still further includes in the steps of selecting and playing a card the steps of selecting a card that can match a number on another card that is in a separate vertical row on the playing surface and playing the selected card on the playing surface by placing it lowermost in the separate vertical row and covering half of the uppermost matching card.

DESCRIPTION OF THE PREFERRED EMBODIMENT

Figure 1:
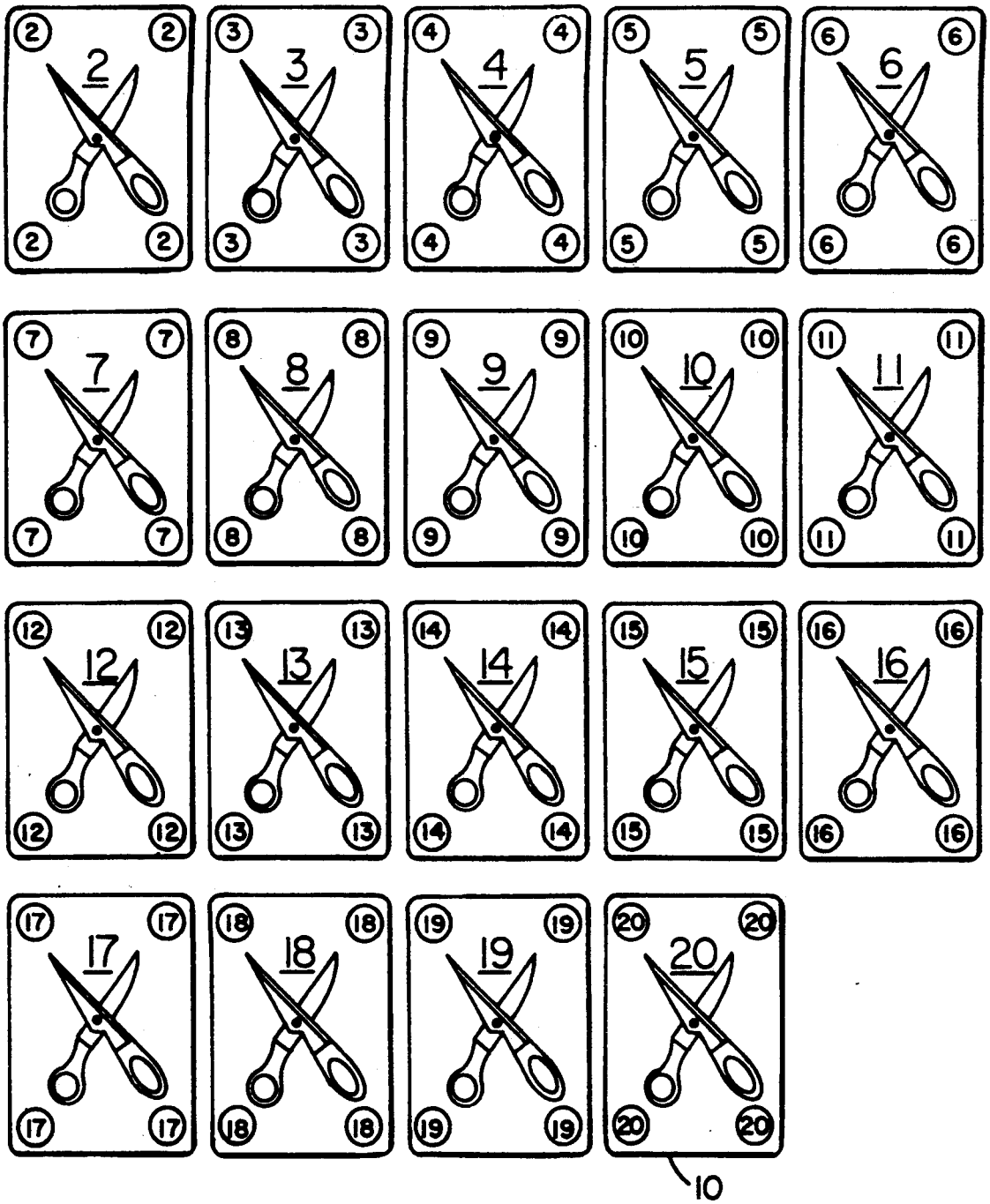
FIG. 1 is a plan view of the front of a representative series of numerical value cards numbering sequentially "2" through "20" and forming part of a deck of playing cards with the deck consisting of four such series.

With reference to FIG. 1 of the drawings, a representative series of numerical playing cards numbering from "2" through "20" is illustrated, with the last card "20" being identified at 10 as being representative of the cards in the card deck for the game to be described herein.

Figure 1A:
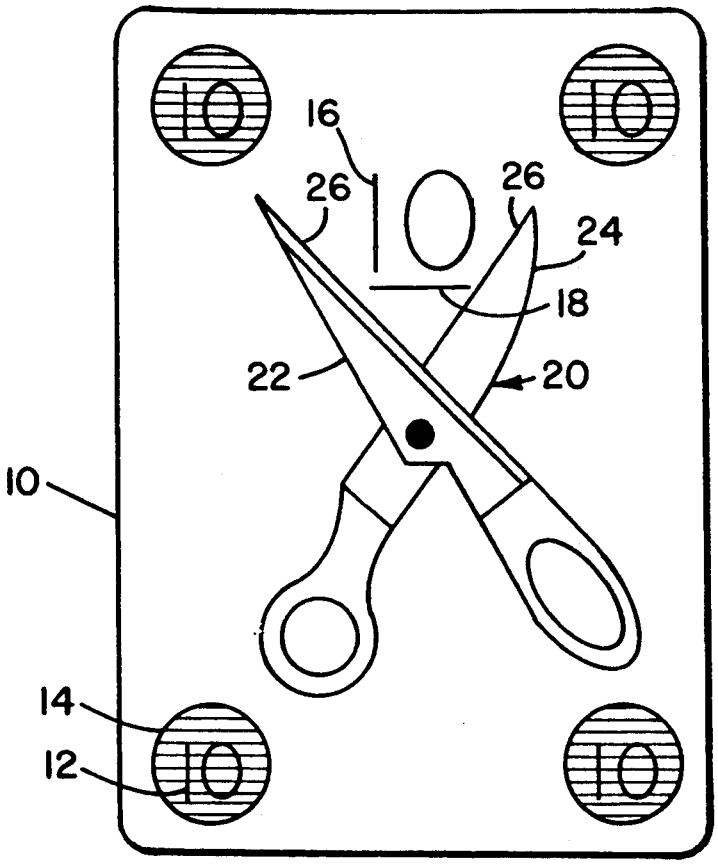
FIG. 1*a* is an enlarged plan view of the front of one of the playing cards from FIG. 1.

With reference to FIG. 1*a*, playing card 10 includes an identifying number 12, which in the drawing is shown having the number "10". The number is encompassed within a circle 14 located at each of the four corners of the playing card; all of the four numbers face in the same direction. The circle 14 may be colored to form a background for the number encompassed therewithin. The same identifying number appears by itself at 16 enlarged, facing in the same direction as the other smaller appearing numbers, and is spaced slightly below and between two of the smaller numbers at the upper end of the playing card. A short line 18 is drawn below the enlarged number to underscore the number. A pair of scissors 20 is illustrated approximately at the center of the playing card 10. The two blades 22, 24 of the pair of scissors are shown in the open position with the opening, as defined by the inner edges 26 of the two open blades, facing the enlarged underscored number.

There are in a deck of playing cards for the game disclosed herein four series of cards, with each series numbered sequentially "2" through "20," as shown in FIG. 1. There are, therefore, a total of seventy-six (76) playing cards in the card deck.

Figure 2:
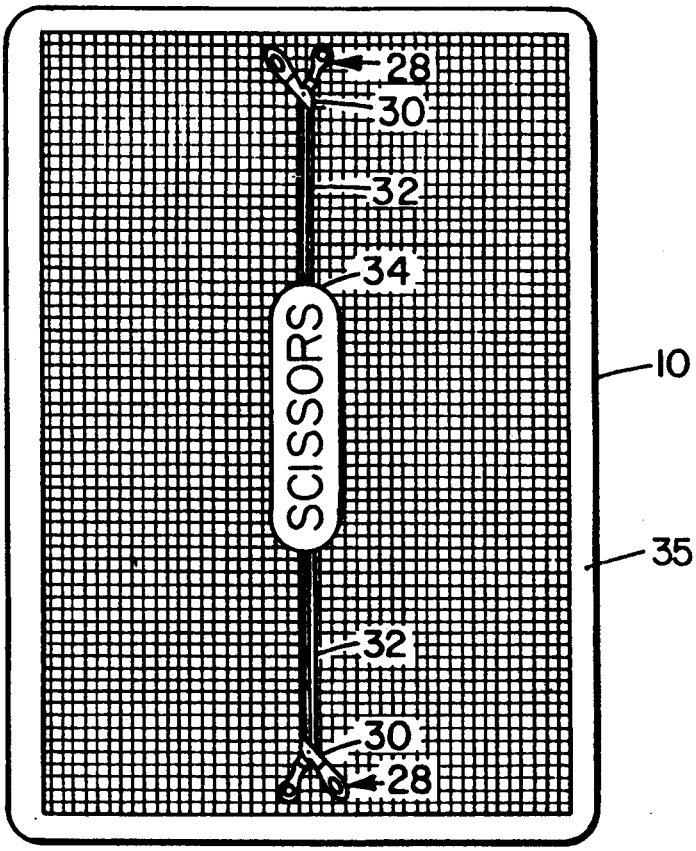
FIG. 2 is an enlarged plan view of the back of a representative playing card.

FIG. 2 shows the back of the playing card 10, which is representative of the backs for all of the playing cards in the card deck. A pair of scissors 28 is illustrated at a centrally located position along the width of the playing card at each end of the long side of the playing card. The blades 30 of each pair of illustrated scissors are truncated and are connected at their point of truncation to a narrow band 32, preferably colored, leading toward the opposite end of the playing card and stopping at the intersection of the band with one end of a centrally located circle 34 that is elongated in the direction of the length of the playing card. The centrally located circle 34 contains therewithin, preferably, the printed word, "SCISSORS," which serves to identify the card game described herein. Each playing card has a white marginal edge 35 on the back of the playing card.

Figure 3:
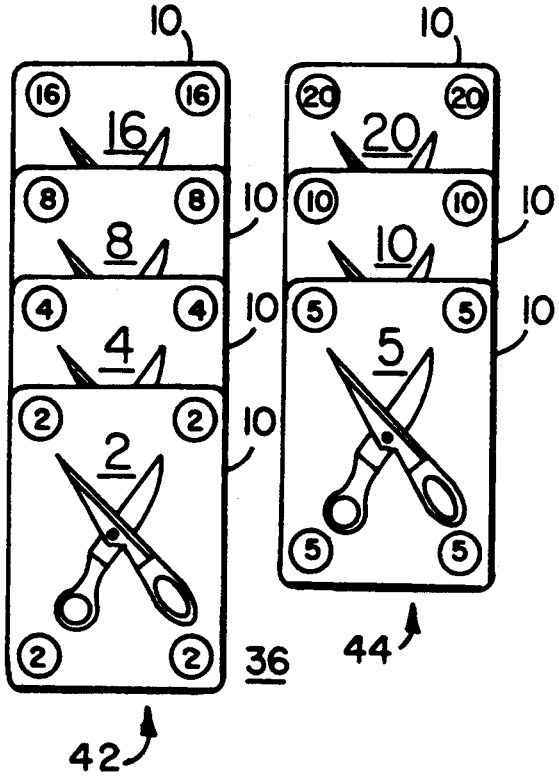
FIG. 3 is a plan view of a typical playing surface illustrating two different vertical rows of cards each row played with a greater numbered card being placed uppermost and a halving numbered card being placed lowermost in the vertical row and covering the lower half of the uppermost card.

In reference to FIG. 3, a typical playing surface is shown at 36, which may be that of any card table, table or board, or any other reasonably flat and level surface on which to play cards.

In the play of the game, the dealer deals a single card 10 to each player in succession until each player has four cards. Upon completion of the deal, the dealer places the remaining cards in the main deck face down on the playing surface 36 to form a draw pile 38 of cards. The draw pile 38 is illustrated in part in FIG. 5. The dealer then starts a discard pile 40 of cards on the playing surface by transferring one card from the draw pile 38 of cards and turning it face up and placing it in the discard pile 40 separate from the draw pile 38. The discard pile 40 is also illustrated in part in FIG. 5.

Figure 4:
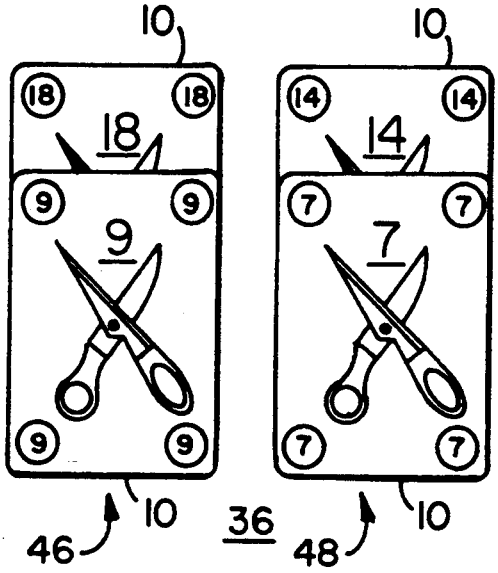
FIG. 4 is a plan view similar to FIG. 3 and illustrating two of the shorter vertical rows possible to be played with a greater numbered card being placed uppermost in a row and a halving numbered card being placed lowermost in the vertical row and covering the lower half of the uppermost card.
Figure 5:
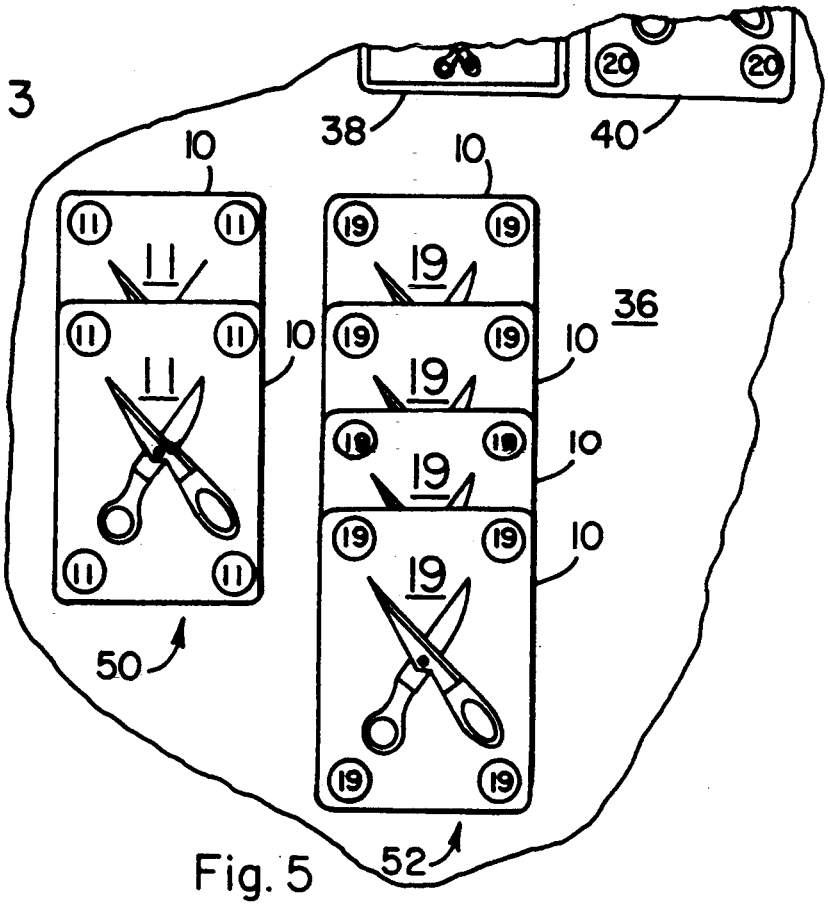
FIG. 5 is a plan view of a typical playing surface partly broken away and illustrating a vertical row of cards played with a numbered card that is not divisible by two being placed in an uppermost position in the vertical row and a matching numbered card being placed in a lowermost position covering half of the uppermost card, and also illustrating fractional portions of a draw pile and of a discard pile.

In reference to FIGS. 3, 4 and 5, the dealer becomes the first player. During the player's turn the player selects from either the top of the discard pile 40 or from the cards in the player's hand a card 10 having a numerical value that is half of or twice the numerical value of a second card from either the top of the discard pile 40 or from the cards in the player's hand. The player then plays both cards by placing the two cards on the playing surface 36 in a vertical row with the greater numerical valued card being placed uppermost and the halving numbered card being placed lowermost in the vertical row and covering half of the uppermost card. The player continues to play, if possible, by selecting either from the top of the discard pile 40 or from the player's hand another card that is half of the number of the lowermost card in the vertical row or is twice the number of the uppermost card in the vertical row, or the player may start a new vertical row of uppermost and lowermost cards on the playing surface 36. The player plays the card by placing the card on the playing surface by covering half of the card above it or by sliding it under half of the card below it in the vertical row. Alternatively, the player may start the aforementioned new vertical row of uppermost and lowermost numbered cards until there are no more cards in the player's hand or on top of the discard pile Capable of being played by the player. The player draws a card from the draw pile 38 of cards, and if it is not possible to play the drawn card, the player then discards a card from the player's hand to the top of the discard pile 40, at which time the player's turn is ended, or alternatively the player has exhausted all of the cards in the player's hand and in which event the player wins the card game. As heretofore mentioned, some of the playing cards in the deck have numerical values that cannot be divided in half by the number on another card, or alternatively, be used to divide in half the number on another card. These cards, the "obstacle" cards, have numerical values of "11," "13," "15," "17" and "19." It should be noted, therefore, that although these are only some of the odd numbered cards appearing in the sequential order of "2" through "20," the other odd numbers in the sequence, "3," "5," "7" and "9," are not considered to be "obstacle" cards because they can be used to "scissor-in-half" or to divide in half other numbered cards in the sequence. These latter odd numbered cards, however, cannot be used to be "scissored-in-half" or to be divided in half by other cards in the sequence.

When a player has one or more of these "obstacle" cards in his or her hand, the player can only select and play such card(s) by selecting a card that can match a number on another card that is not divisible by two, and then must play those cards on the playing surface 36 in a separate vertical row by placing one of the matched numbered cards uppermost and the other matching card lowermost in the separate vertical row and covering half of the uppermost card. If another player has already started a new vertical row with matching cards, then the player whose turn it is may select a card that can match one of the matching numbers on the playing surface and play the selected card by placing it lowermost in the existing vertical row on the playing surface and covering half of the uppermost matching card. Since there are in the card deck four series of cards sequentially numbered from "2" through "20," it may be possible during the play of one game for one or more players to play all four of the same matching numbers in a single, separate vertical row. Strategically, a player may decide it would be advantageous to use as a discard from the hand an "obstacle" card instead of waiting until that player has a next turn to see if a matching "obstacle" card might become available during that turn.

The game can be played very quickly, and it is conceivable that in the combination of the arrangement of the cards following the deal and the card that is first turned face up in the discard pile by the dealer might make it possible for the first player during his or her turn to exhaust all of the cards in his or her hand and thus win the game. In that event, a new game may be commenced and the deal of the cards passes to the next player.

Scoring may simply depend as to which of the players during the series of games played won the most games. Scoring could also involve giving special points to the player or players playing "obstacle" or matching cards.

In reference to the drawings, it may be observed from FIG. 3, that the longest vertical row possible to make on the playing surface during a game, when using cards having sequential numbering from "2" through "20," is the vertical row 42 involving cards numbered "16," "8," "4," and "2." The next longest possible vertical row may also be observed from FIG. 3 and would include cards numbered "20," "10" and "5," as shown in vertical row 44. The shortest vertical rows possible in the sequential order of cards in the card deck would be the ones that include cards numbered "18" and "14," because they can only be "scissored-in-half" or be divided in half, respectively, by the cards numbered "9" and "7," as shown in FIG. 4 by vertical rows 46 and 48. This is not to say, of course, that other short vertical rows could not occur. For instance, perhaps only the card numbered "16" was "scissored-in-half" or divided in half by the card numbered "8," or the card numbered "4" was "scissored-in-half" or divided in half by the card numbered "2," before that particular game ended.

In reference to FIG. 5, the vertical row 50 illustrates the play on the playing surface 36 of two matching "obstacle" cards, each having the number "11," which would be initiated and played by one of the players during one game. Vertical row 52 illustrates the play on the playing surface 36 of four matching "obstacle" cards, each having the number "19," which conceivably could be played by one or more of the players during one game. It does not matter which of the "obstacle" or matching cards is initially placed uppermost on the playing surface 36 and which is played lowermost. The lowermost card is used to cover the lower half of the uppermost card.

To make the game still more challenging as well as interesting, a time limit, such as 15 minutes, when there are only two players involved, could be established within which all of the games during one session must be played, thus forcing each player to determine strategy and make decisions quickly, as to what to play and what to discard. If three players are involved, the time limit could be 20 minutes, and if four players are involved, the time limit could be 25 minutes, to ensure sufficient time for the dealing of the cards to go around to all of the players at least two or more times during a session.

Although the preferred embodiment described herein involves a deck of cards having playing cards of sequential numerical values extending from 2 through 20, if desired, the sequence could be increased or changed so as to start from a different or higher numerical value than the numerical value of 2 to form an entirely different sequential order. The game, however, would still be played in the same manner, and the object, of being the first player to exhaust all of the cards and thus win the game, would still be the same. Also,, in a different or longer sequence of numbers, it might be desirable to increase the number of cards dealt to each player.

The invention has been described in detail with particular reference to preferred embodiments thereof, but it will be understood that variations and modifications can be effected within the spirit and scope of the invention.

I claim:

1. A method of playing a card game wherein the playing cards include a series of numerical value cards in a predetermined sequential order, said method comprising the steps of:

dealing a predetermined number of cards from a main deck of cards to each player and upon completion of the deal placing the remaining cards in the main deck of cards face down on a playing surface to form a draw pile of cards and starting a discard pile of cards on said playing surface by transferring one card from said draw pile of cards and turning it face up and placing it in said discard pile on said playing surface separate from said draw pile of cards, selecting during a player's turn from either the top of said discard pile or from the cards in the player's hand a card having a number that a) is half of or twice the number of a second card from either the top of said discard pile or from the cards in the player's hand, and playing both cards by placing the cards on said playing surface in a vertical row with the greater numbered card being placed uppermost and the halving numbered card being placed lowermost in said vertical row and covering half of the uppermost card, and continuing to play by selecting either from the top of said discard pile or from the player's hand another card that b) is half of the number of the lowermost card in said vertical row or is twice the number of the uppermost card in said vertical row, or c) may start a new vertical row of said uppermost and said lowermost cards on said playing surface, and playing the card by placing the card on said playing surface by covering half of the card above it or by sliding it under half of the card below it in said vertical row, or by starting said new vertical row of uppermost and lowermost numbered cards until there are no more cards in the player's hand or on top of said discard pile capable of being played by the player, drawing a card from said draw pile of cards, and if it is not possible to play the drawn card, then discarding a card from the player's hand to the top of said discard pile, at which time the player's turn is ended, or alternatively the player has exhausted all of the cards in the player's hand and in which event the player wins the card game.

2. The method of playing a card game as defined in claim 1 and wherein the step of dealing a predetermined number of cards to each player includes the step of dealing a single card to each player in succession until each player has four cards.

3. The method of playing a card game as defined in claim 1 and wherein the step of drawing a card from said draw pile of cards includes the step of the player continuing to draw a card from said draw pile of cards until the player can no longer play the drawn card.

4. The method of playing a card game as defined in claim 1 and wherein the step of discarding a card from a player's hand to the top of said discard pile triggers the step of passing play onto the next player.

5. The method of playing a card game as defined in claim 1 and wherein the steps of selecting and playing a card include the steps of selecting a card that can match a number on another card that is not divisible by two and playing cards on said playing surface in a separate vertical row by placing a matched numbered card uppermost and the selected matching numbered card lowermost in said separate vertical row and covering half of the uppermost card.

6. The method of playing a card game as defined in claim 5, and wherein the steps of selecting and playing a card include the steps of selecting a card that can match a number on another card that is in said vertical row on said playing surface and playing the selected card on said playing surface by placing it lowermost in said vertical row and covering half of the uppermost matching card.

7. The method of playing a card game as defined in claim 1, and wherein the steps of selecting and playing a card include the steps of selecting a card that can match a number on another card that is not divisible by two and that cannot be used to halve the number of any other card in said sequential order, and playing the cards on said playing surface in a separate vertical row by placing a selected matched numbered card uppermost and a selected matching numbered card lowermost in the separate vertical row and covering half of the uppermost card.

* * * * *